US006405491B1

(12) United States Patent
Gallant

(10) Patent No.: US 6,405,491 B1
(45) Date of Patent: Jun. 18, 2002

(54) MODULAR PATIENT ROOM

(75) Inventor: Dennis J. Gallant, Harrison, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 09/298,257

(22) Filed: Apr. 22, 1999

(51) Int. Cl.[7] ..... A47F 10/00

(52) U.S. Cl. ..... 52/36.1; 52/36.4; 52/34; 52/220.1; 52/220.2; 52/35; 52/64

(58) Field of Search ..... 52/34, 36.1, 220.7, 52/220.3, 220.1, 238.1, 64, 110, 111, 220.2

(56) References Cited

U.S. PATENT DOCUMENTS

| | | | | | |
|---|---|---|---|---|---|
| 3,115,819 | A | | 12/1963 | Mahlmeister et al. | |
| 3,294,480 | A | | 12/1966 | Potapenko | |
| 3,378,963 | A | | 4/1968 | Obata | |
| 3,601,031 | A | | 8/1971 | Abel et al. | |
| 3,660,591 | A | * | 5/1972 | Schultz et al. | 174/70 |
| 3,727,753 | A | * | 4/1973 | Starr et al. | 206/65 |
| 3,742,932 | A | | 7/1973 | Greenspan | |
| 3,774,522 | A | | 11/1973 | Marsh | |
| 4,202,676 | A | | 5/1980 | Pelosi, Jr. et al. | |
| 4,267,769 | A | * | 5/1981 | Davis et al. | 98/33 |
| 4,359,843 | A | | 11/1982 | Schachar | |
| 4,360,991 | A | | 11/1982 | West | |
| 4,409,889 | A | | 10/1983 | Burleson | |
| 4,506,595 | A | | 3/1985 | Roberts et al. | |
| 4,569,163 | A | | 2/1986 | Long | |
| 4,586,759 | A | | 5/1986 | Wrobel | |
| 4,667,579 | A | | 5/1987 | Daw | |
| 4,850,268 | A | | 7/1989 | Saito et al. | |
| 5,065,462 | A | * | 11/1991 | Romano | 4/604 |
| 5,074,894 | A | | 12/1991 | Nelson | |
| 5,086,593 | A | | 2/1992 | Walentine | |
| 5,107,636 | A | | 4/1992 | Schindele et al. | |
| 5,152,814 | A | | 10/1992 | Nelson | |
| 5,212,915 | A | | 5/1993 | Antonio | |
| 5,256,105 | A | | 10/1993 | Austin | |
| 5,359,820 | A | * | 11/1994 | McKay | 52/34 |
| 5,425,793 | A | | 6/1995 | Mori et al. | |
| 5,903,937 | A | * | 5/1999 | Clarke | 4/663 |

* cited by examiner

*Primary Examiner*—Beth A. Stephan
*Assistant Examiner*—Patrick J. Chavez
(74) *Attorney, Agent, or Firm*—Barnes & Thornburg

(57) ABSTRACT

A modular patient room includes a plurality of wall panels having various configurations and one or more plumbing units. The wall panels and plumbing units are connectable to each other to form the patient room. Each plumbing unit includes a water conduit and a water-using device that is connected to the water conduit. In some embodiments, the modular patient room includes modular patient service equipment that couples to the wall panels.

54 Claims, 6 Drawing Sheets

122
188
122
188
122
198
197
36
22
48
52
50
46
54
56
168
166
188
168
166
188
158
198
158
160
168
166
162
122
158
160

MODULAR PATIENT ROOM

BACKGROUND AND SUMMARY OF THE INVENTION

The present invention relates to adaptable clinical environments and more particularly relates to modular components for rapid installation into a clinical environment to provide for reconfiguration of the clinical environment.

Modular components for dividing open spaces into cubicles and rooms are well known.

A modular patient room for installation in a healthcare facility having gas supply lines, electrical supply lines, and water supply lines in accordance with the present invention includes wall panels having oppositely facing spaced apart wall surfaces, oppositely facing spaced apart side walls configured for joining to the side wall of another wall panel, a top surface, a bottom surface, and an interior. One of the wall panels includes a conduit having a first end extending through a wall surface of the wall panel and a second end separated from the first end by an internal portion disposed in the interior of wall panel, the second end extending through one of the sidewalls, top surface, and bottom surface and being configured for connection to one of the gas, electrical and water supply lines. The modular patient room may also include couplings in the side walls connected to the second end of the conduit, the couplings being designed and arranged to couple conduits of abutting wall panels. Also a cavity may be formed in the wall surface so that the first end of conduit can extend through cavity of wall surface, and a panel may be pivotally attached to wall surface to pivot between a first position in which first end of conduit is concealed and a second position in which first end of conduit is accessible. The conduit may be gas piping or electrical wiring.

A modular system for use in a healthcare facility in accordance with the present invention includes a plurality of wall panels having side walls and a unit having edge walls and also having water supply and waste water conduits formed therein for connection to a water-using device. The edge walls of the unit and the side walls of the wall panels include connectors configured to join to connectors of other wall panels and units. The unit may comprise a shower unit having walls extending upwardly from a basin, a drain positioned in the basin and connected to the waste water conduit, and a shower head connected to the water supply conduit; a toilet unit having a wall with a toilet attached thereto, the toilet having a flushing mechanism connected to the water supply conduit and a drain connected to the waste water conduit; or a sink unit having a wall with a basin, a drain extending through the basin and connected to the waste water conduit, and a faucet connected to the water supply conduit.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

FIG. 1 illustrates the assembly of a patient room from variously configured wall panels and modular patient service equipment;

FIG. 2 is a perspective view of a conventional wall wired and plumbed for receipt of modular patient service equipment;

FIG. 3 is a perspective view of a partially assembled patient room showing a conventional wall, two walls constructed from wall panels, and free standing wall panels which will be assembled by workers to form the fourth wall of a patient room;

FIG. 4 is a perspective view of a patient room with two walls removed for clarity showing a conventional wall and a wall constructed of prefab panels to which modular patient service equipment has been coupled;

FIG. 5 includes three time lapse perspective views of a patient room which originally included a modular shower unit, a passageway wall panel and another wall panel forming an enclosed bathroom which is disassembled to provide an open bathroom more conducive to intensive care;

FIGS. 6–8 are perspective views of a two walls of a patient room with a conventional wall plumbed and wired with outlets and couplings to which various modular patient service equipment is attached to form a headwall;

FIG. 9 is a perspective view of a wall formed from an alternative embodiment of wall panels providing concealable lighting, gas and electrical services;

FIG. 10 is a cross-sectional view of the alternative wall panel of FIG. 9 showing the lighting and electrical and gas connections positioned to provide patient services;

FIG. 11 includes two time lapse perspective views of two adjacent patient rooms formed from alternative wall panels and modular patient service equipment being converted from a medical surgical complex to a critical care unit;

FIG. 12 is a perspective view of a patient room created from alternative wall panels including pre-wired and pre-plumbed patient services which are concealed;

FIG. 13 is a perspective view of two alternative wall panels including pre-wired and pre-plumbed patient services which can be concealed showing the panel on the right having lighting and electrical and gas services in their non-concealed positions and the panel on the left having the lighting and electrical and gas services concealed; and FIG. 14 is a perspective view of a patient room with one wall removed for clarity including a headwall and an entry wall formed from wall panels, a bathroom formed from a sink panel, a wall panel, an entry panel, and a shower unit with modular patient service equipment attached to the headwall.

DETAILED DESCRIPTION OF THE DRAWINGS

Figure 1:
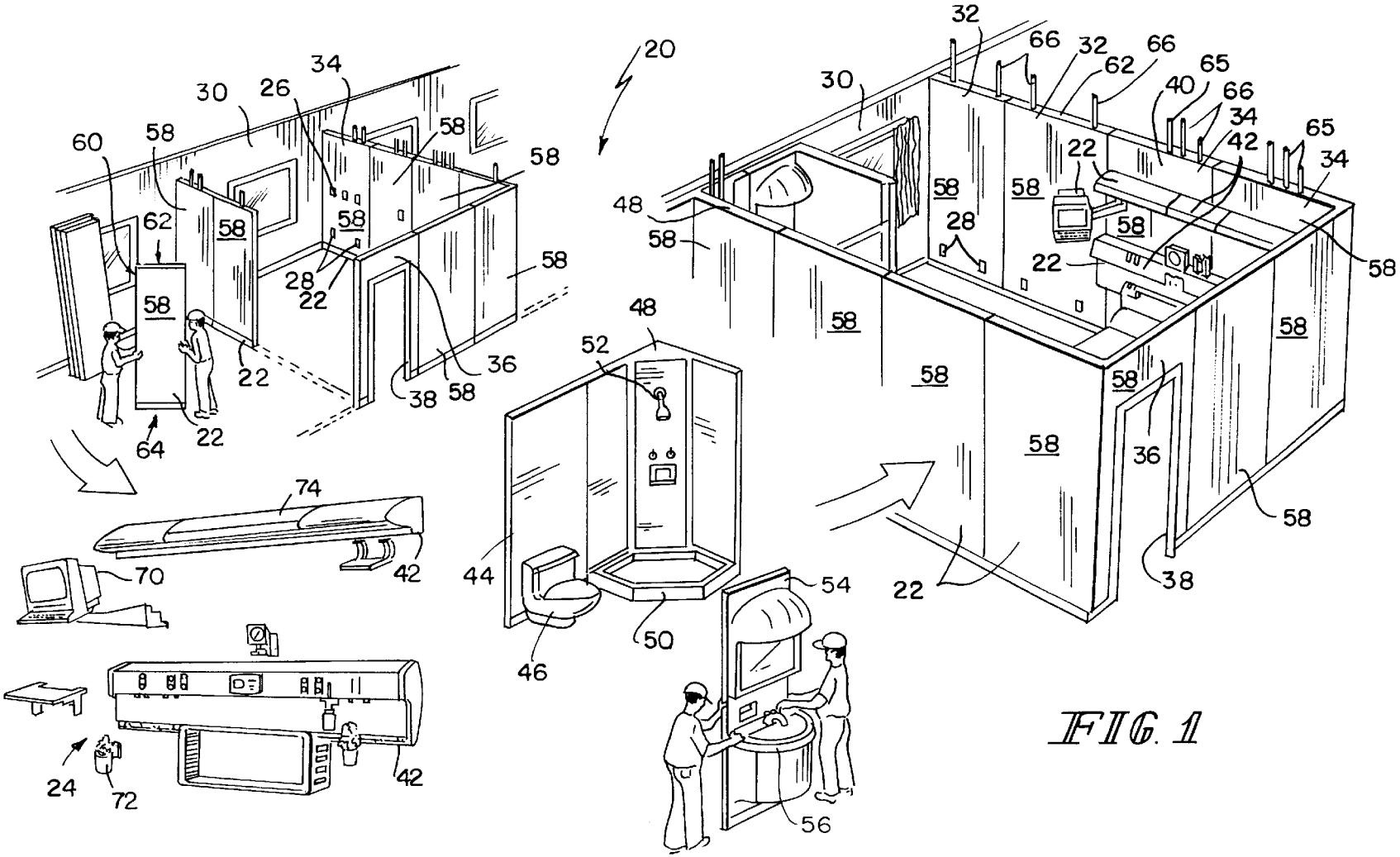
FIGS. 1–14 illustrate the modular walls and modular patient service equipment for attachment to walls to create and reconfigure rooms in healthcare facilities.
Figure 2:
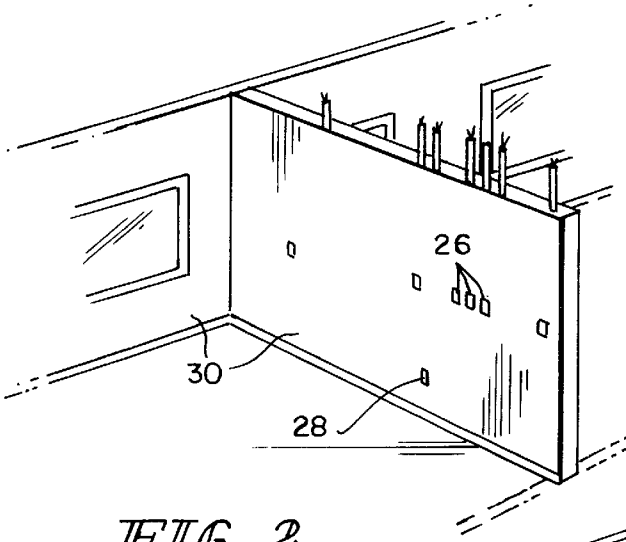
Figure 3:
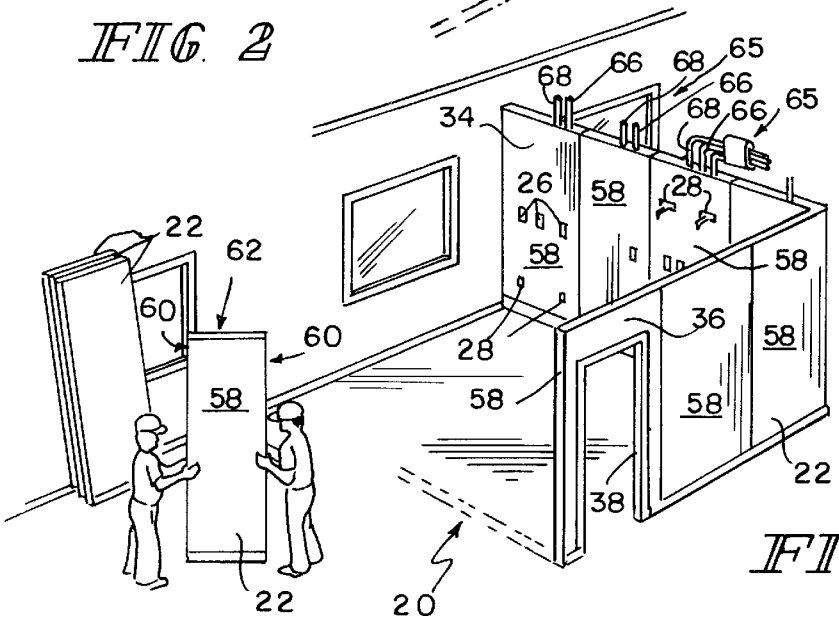
Figure 4:
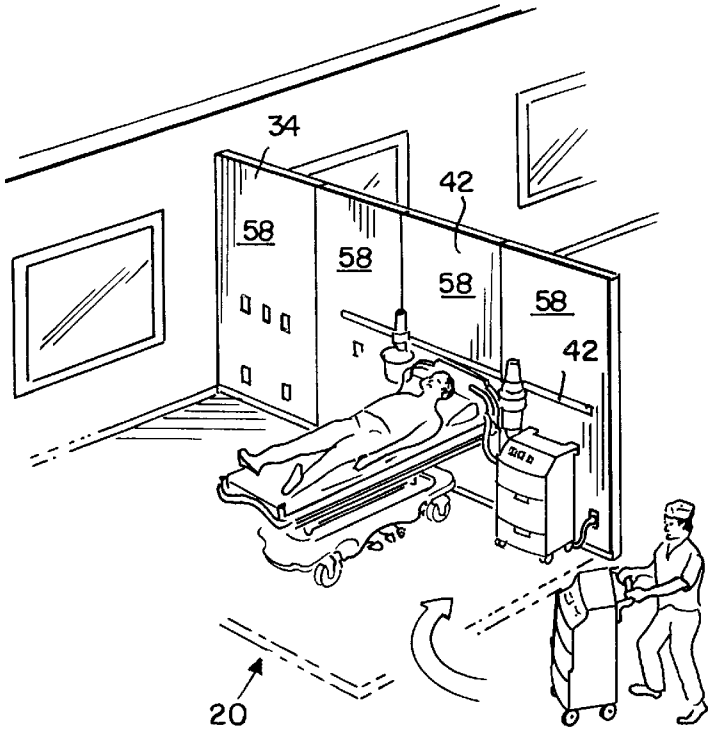
Figure 5:
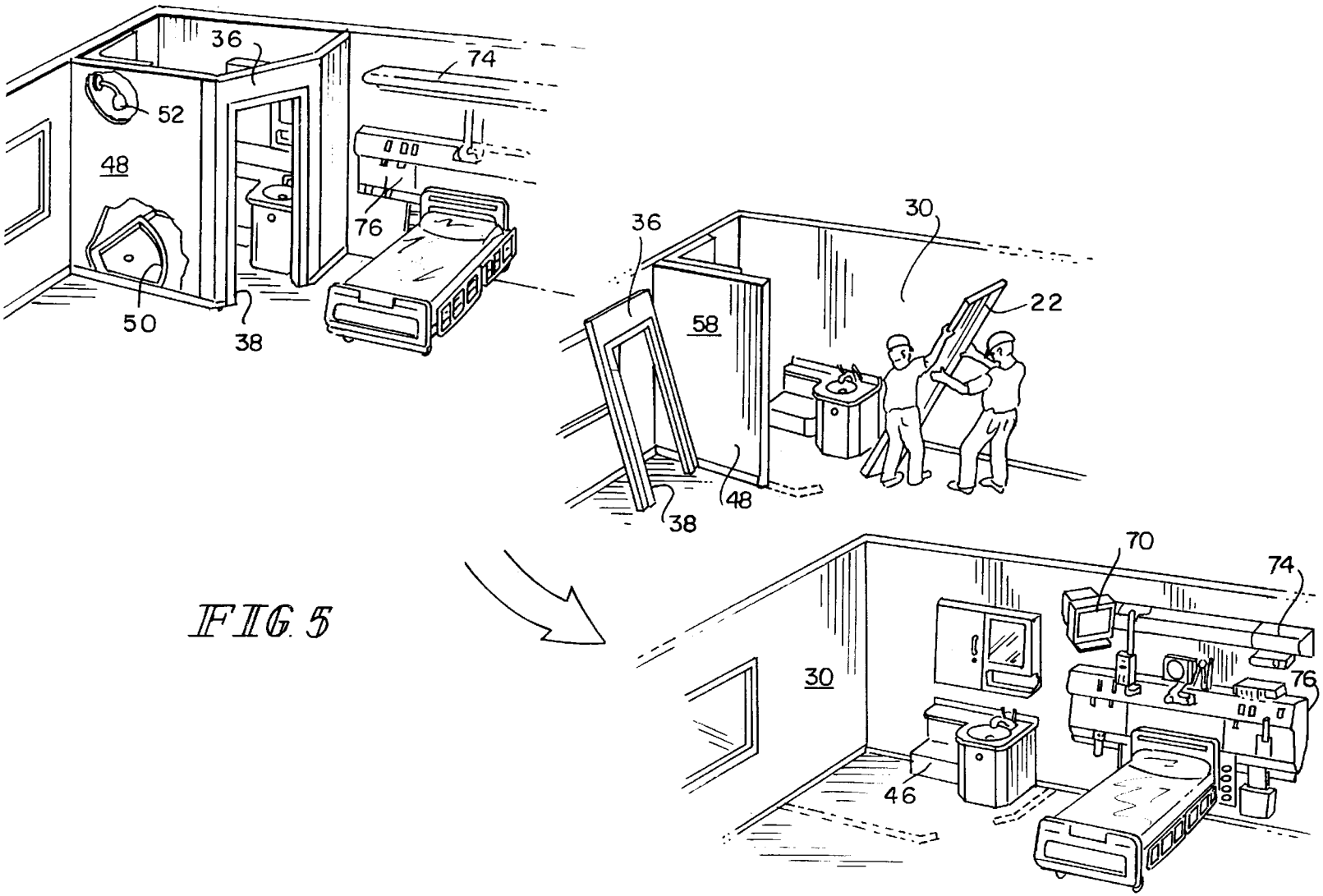
Figure 8:
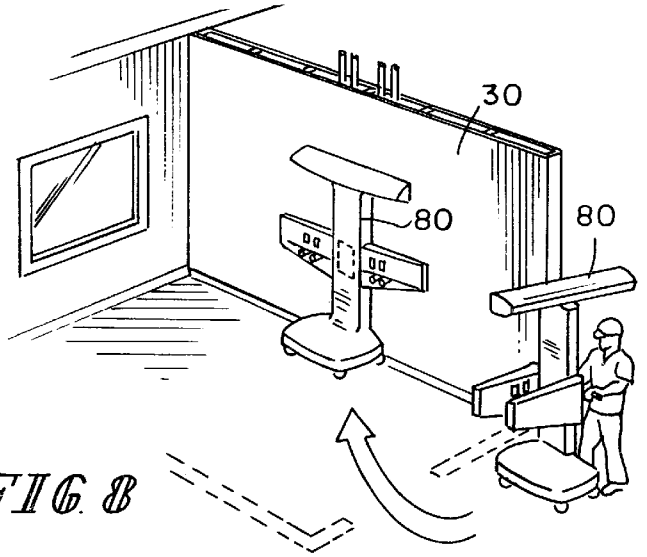

As shown in FIG. 1, an adaptable clinical environment or modular patient room 20 includes variously configured wall panels 22 and modular patient service equipment 24. Modular patient service equipment 24 may be connected to couplings 26 and outlets 28 formed in wall panels 22 or conventional walls 30. Prefabricated modular wall panels 22 are designed to be joined together and to existing conventional walls 30 to facilitate the creation of and reconfiguration of patient rooms. Modular wall panels 22 are configured for rapid clean installation and for joining to permanent conventional walls 30 or other modular wall panels 22 in multiple configurations so that a healthcare facility floor space can be customized to suit patient needs.

Various configurations of modular wall panels 22 are provided, including an electrical outlet panel 32 including one or more electrical outlets 28 hardwired therein, an electrical/gas panel 34 including one or more electrical outlets 28 hardwired therein and one or more gas outlets 26 plumbed therein, a entry way panel 36 formed to include a door frame 38 therein, a window panel 35 formed to include a window 37 therein, a headwall panel 40 including hardwired and brazed electrical and gas connections 28, 26 configured for receipt of modular headwall components 42 of modular patient service equipment 24. An alcove wall panel 39 formed to include a computer station 41 is also designed for modular assembly. A modular bathroom is also provided which includes a toilet panel 44 with a toilet 46 attached thereto and properly plumbed with water supply lines and waste water disposal lines (not shown), a shower unit 48 with basin 50 and shower head 52 appropriately plumbed for water supply and waste water disposal (not shown), a sink panel 54 with a sink basin 56 attached thereto and appropriately plumbed for water supply and disposal (not shown). The supply and disposal lines are not shown as they extend through the interior of the unit.

It will be understood that all wall panels 22 include oppositely facing spaced apart wall surfaces 58 with side walls 60 extending therebetween, a top surface 62, and a floor engaging surface 64 defining an interior of the panel 22. Wall panels 32, 34, 40, 39, 44, 54 and units 48 with electrical outlets 28 and or gas couplings 26 extending through the wall surface 58, and/or plumbing connections (not shown) have the conduits 65 including wiring 66 and piping 68 arranged to extend through the interior of the panel 22 or unit between the outlet 28, coupling 26, and/or connection and the top surface 62 through which the wiring or plumbing extends. Healthcare facilities typically include false ceilings above which electrical, gas, and plumbing supply lines extend. Wiring 66 and piping 68 extending through top surface 62 for connection to supply lines above the false ceiling.

Modular patient service equipment 24 includes modular headwall components 42 and other components such as, a monitor 70, a pressure regulator 72 and the like. Multiple headwall components 42 are also provided including a lighting unit 74, a Hi-Acute headwall unit 76, a lo acute headwall unit 78, and a mobile headwall unit 80 all of which are available from Hill-Rom, Inc, Batesville, Ind. It will be understood that, the outlets 28 and couplings 26 extending through wall surface 58 of wall panels 22 are arranged and configured to mate with coupling and connectors on the modular patient service equipment 24 so that power, fluids, pressurized gasses, and vacuum may be supplied to the modular patient service equipment 24 upon connection of the same to a wall panel 22.

Figure 10:
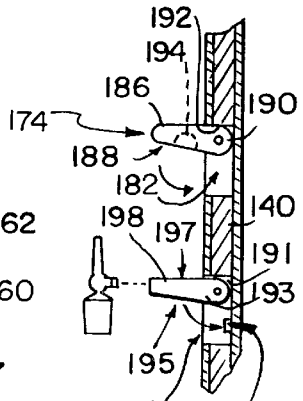
Figure 9:
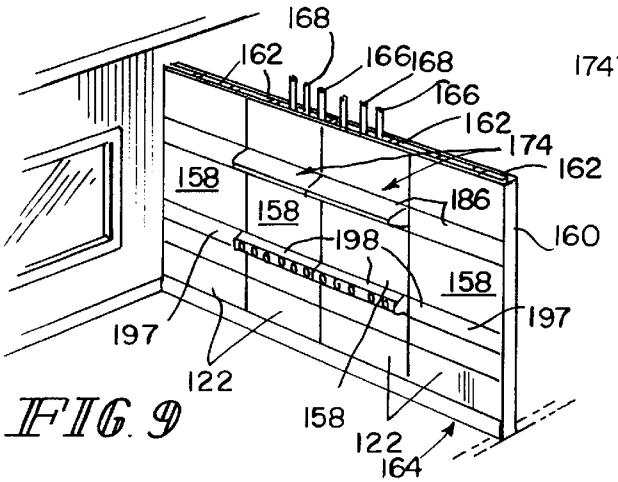
Figure 6:
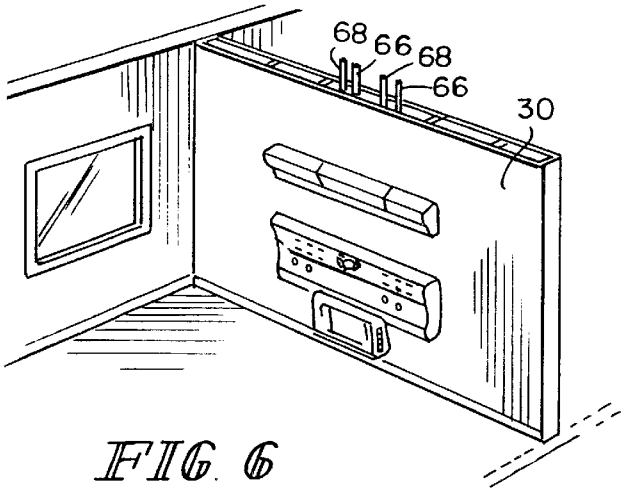
Figure 7:
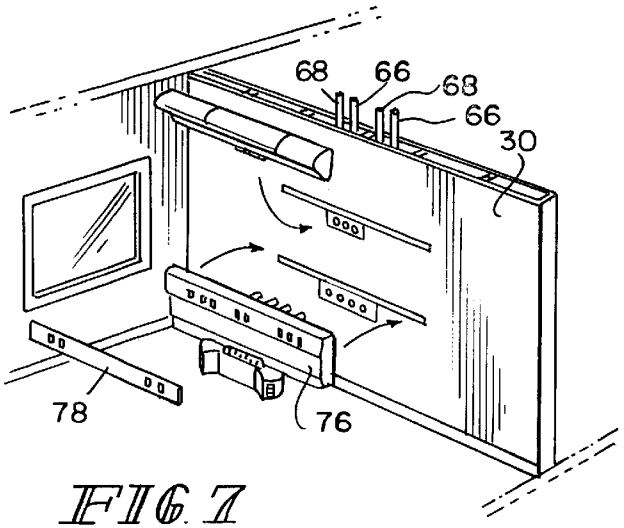
Figure 11:
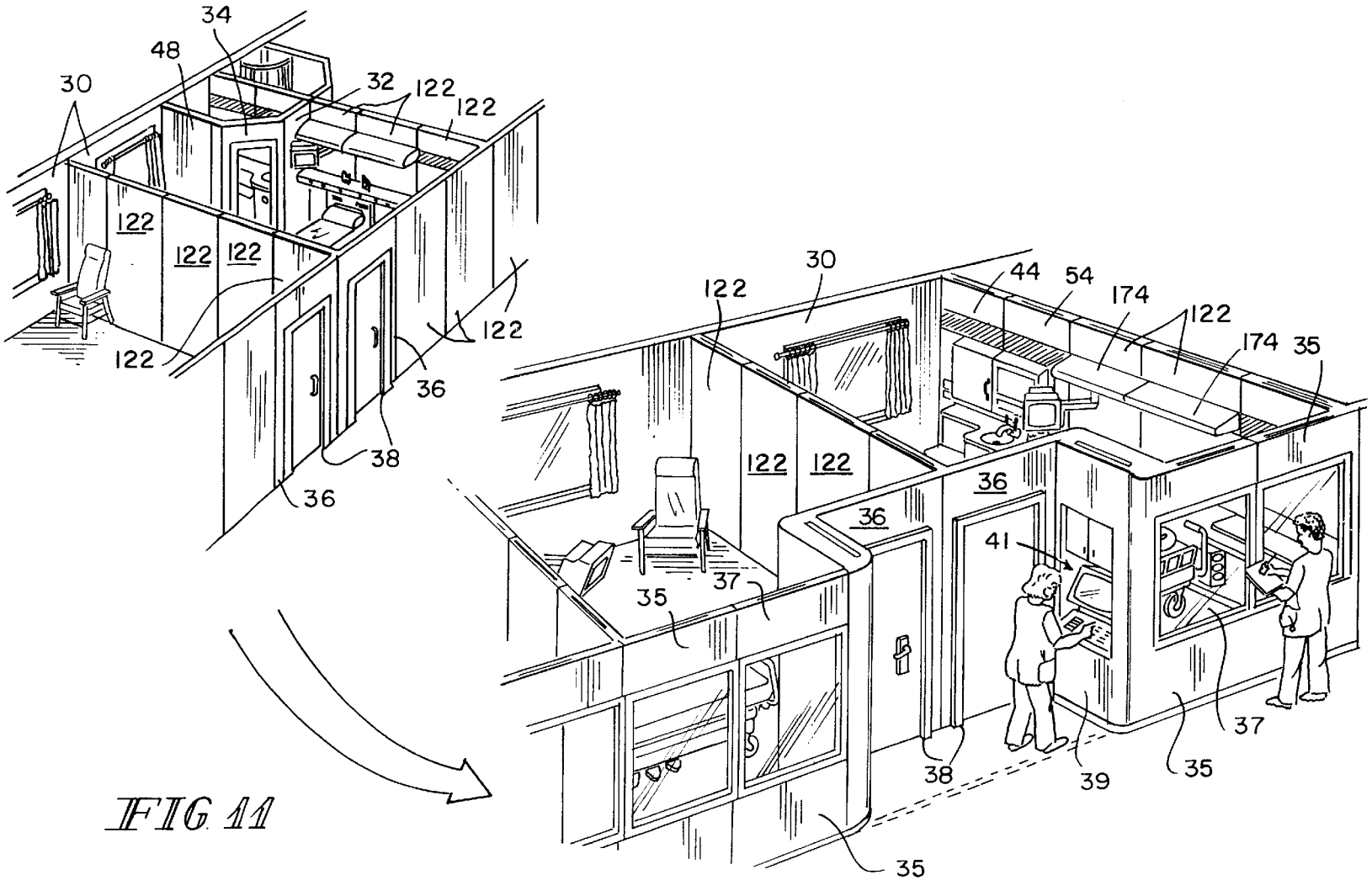

An alternative wall panel 122 is illustrated in FIGS. 9–14. Wall panels 122 include oppositely facing spaced apart wall surfaces 158 with side walls 160 extending therebetween, a top surface 162, and a floor engaging surface 164 defining an interior of the panel 122. Illustratively, wall panel 122 is formed to include a laterally extending light cavity 182 extending inwardly from wall surface 158 and includes a lighting unit 174 pivotally mounted within cavity 182. Illustratively, lighting unit 174 includes a panel 184 having a decorative surface 186 and a light housing surface 188. Light panel 184 is pivotally mounted at one end 190 to top 192 of cavity 182 so that when light panel 184 is pivoted inwardly decorative surface 186 lies substantially parallel to wall surface 158 while light housing surface 188 is disposed within cavity 182 and concealed from view. As shown in FIG. 10, when panel 184 is rotated 90 degrees, light housing surface 188 is disposed so that an electric light 194, such as an incandescent or florescent bulb, can provide illumination to the room. Power is provided to light 194 through internal wiring 166 in wall panel 122.

Wall panel 122 also includes a laterally extending service cavity 196 within which electrical outlets 128 and gas couplings 126 are positioned. A service panel 198 having a decorative side 197 and a fixture-facing side 195 is pivotally mounted at one end 193 to top 191 of service cavity 196. When service panel 198 is rotated inwardly, decorative side 197 is substantially parallel to wall surface 158 and electrical outlets 128 and gas couplings 126 are concealed. When service panel 198 is rotated outwardly, access is provided to electrical outlets 128 and gas couplings 126 for connection of modular patient service equipment 24 thereto.

Figures 12, 13, 14:
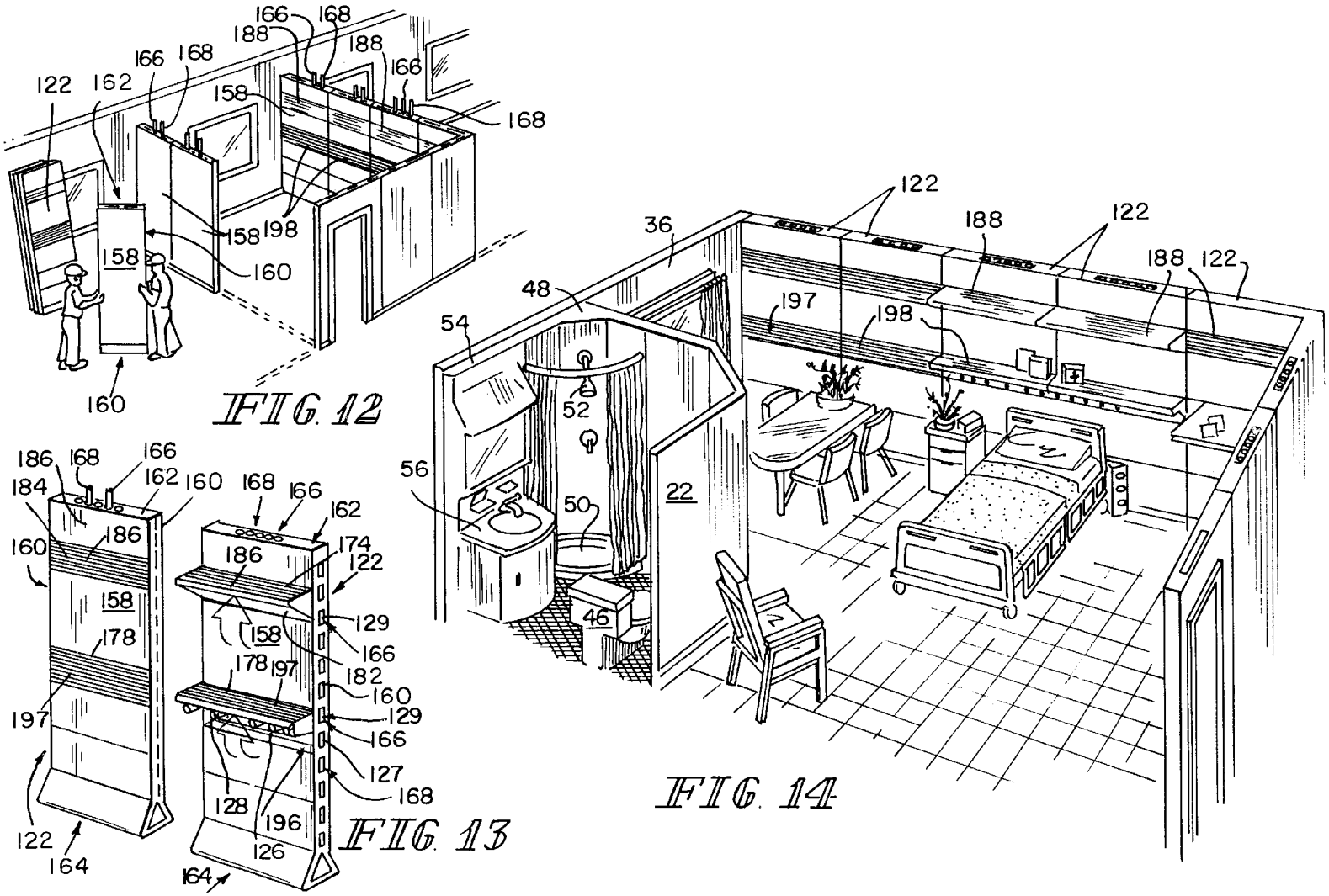

As shown, for example, in FIG. 13, couplings 127 and connectors 129 are provided in side walls 160 to connect internal electrical wiring 166 and gas piping 168 of adjacent wall panels 122 when they are connected. The wiring 166 and piping 168 extends through the interior of the panel 122 to provide electricity to outlet 128, and gas to coupling 126. Wiring 166 and plumbing 168 also extend through top surface 162 to connect to gas and electric supply lines in the ceiling.

Although the invention has been described in detail with reference to certain preferred embodiments, variations and modifications exist within the scope and spirit of the invention as described and defined in the following claims.

What is claimed is:

1. A modular patient room for installation in a healthcare facility having gas supply lines, electrical supply lines, water waste lines, and water supply lines, the modular patient room comprising:

a wall made from a plurality of wall panels each having oppositely facing spaced apart surfaces, oppositely facing spaced apart sides, a top, and a bottom, said surfaces, sides, top, and bottom of each wall panel defining an interior of the respective wall panel, the sides of each wall panel being removably connectable to the side of another wall panel to form the wall, and a plurality of water conduits, each having a first end extending from the associated wall panel and a second end extending from the associated wall panel, and each water conduit including an internal portion within the interior of the associated wall panel connecting the respective first end to the respective second end, each water conduit being connectable to one of a water supply or water waste line, the second end of at least one water conduit extending from one of the sides, and the apparatus further comprising a coupling connected to the second end of the at least one water conduit, the coupling being designed and arranged to couple to a water conduit of an abutting wall panel.

2. The apparatus of claim 1, further comprising an additional conduit having a portion in the interior of one of the wall panels and a first end extending through one of the tops.

3. The apparatus of claim 1, further comprising an additional conduit having a portion in the interior of one of the wall panels and a first end extending through one of the sides.

4. The apparatus of claim 2, wherein one of the wall surfaces includes a service cavity and the additional conduit extends to one of a gas coupling or an electrical connector that is positioned within the service cavity.

5. The apparatus of claim 4, further comprising a service panel movable relative to the service cavity between a first position in which the gas coupling or electrical connector is concealed and a second position in which the gas coupling or electrical connector is accessible.

6. The apparatus of claim 1, further comprising at least one additional conduit that is configured to supply gas and at least a portion of the additional conduit is situated in the interior of one of the wall panels.

7. The apparatus of claim 1, further comprising at least one additional conduit that carries electrical wiring and at least a portion of the additional conduit is situated in the interior of one of the wall panels.

8. The apparatus of claim 7, wherein the electrical wiring is connected to a light fixture.

9. A modular system for use in a healthcare facility comprising:

a headwall unit;

a plurality of modular wall panels having sides, at least one of the wall panels being pre-plumbed with a gas conduit and a coupling that is connectable to the headwall unit to supply gas to the headwall unit; and a plumbing unit having a wall and a water-using device attached to the wall, the plumbing unit being pre-plumbed with a water supply conduit, the water supply conduit being connected to the water-using device, the plumbing unit having edges connectable to the sides of the wall panels by connectors configured to join to connectors of the wall panels and the wall panels being connectable to one another so that after the plurality of wall panels and the plumbing unit are connected together and after the headwall unit is connected to the coupling a room having a headwall unit and a water-using device is provided in the healthcare facility.

10. The system of claim 9, wherein the water-using device includes a shower head connected to the water supply conduit.

11. The system of claim 9, wherein the water-using device includes a toilet connected to the water supply conduit.

12. The system of claim 9, wherein the water-using device includes a faucet connected to the water supply conduit.

13. The apparatus of claim 2, wherein the additional conduit is configured to supply gas.

14. The apparatus of claim 2, wherein the additional conduit is configured to supply vacuum.

15. The apparatus of claim 2, wherein the additional conduit is configured to carry electrical wiring.

16. The apparatus of claim 2, wherein the wall panel associated with the additional conduit is separate from the wall panels associated with the plurality of water conduits.

17. The apparatus of claim 3, wherein the additional conduit is configured to supply gas.

18. The apparatus of claim 3, wherein the additional conduit is configured to supply vacuum.

19. The apparatus of claim 3, wherein the additional conduit is configured to carry electrical wiring.

20. The apparatus of claim 3, wherein the wall panel associated with the additional conduit is separate from the wall panels associated with the plurality of water conduits.

21. The apparatus of claim 3, wherein one of the wall surfaces includes a service cavity and the additional conduit extends to one of a gas coupling or an electrical connector that is positioned within the service cavity.

22. The apparatus of claim 21, further comprising a service panel movable relative to the service cavity between a first position in which the gas coupling or electrical connector is concealed and a second position in which the gas coupling or electrical connector is accessible.

23. The apparatus of claim 21, wherein the wall surface in which the service cavity is formed is also formed to include a light cavity and further comprising a lighting unit mounted to a portion of the wall surface forming the light cavity.

24. The apparatus of claim 23, wherein the lighting unit is movable between a first position in which a portion of the lighting unit extends out of the light cavity and a second position in which the lighting unit is positioned within the light cavity.

25. The apparatus of claim 23, wherein the lighting unit includes a panel and an electric light coupled to the panel, the panel is movable to a first position in which the electric light is exposed, and a second position in which the electric light is concealed in the cavity.

26. The apparatus of claim 4, wherein the wall surface in which the service cavity is formed is also formed to include a light cavity and further comprising a lighting unit mounted to a portion of the wall surface forming the light cavity.

27. The apparatus of claim 26, wherein the lighting unit is movable between a first position in which a portion of the lighting unit extends out of the light cavity and a second position in which the lighting unit is positioned within the light cavity.

28. The apparatus of claim 26, wherein the lighting unit includes a panel and an electric light coupled to the panel, the panel is movable to a first position in which the electric light is exposed, and a second position in which the electric light is concealed in the cavity.

29. The apparatus of claim 6, wherein the additional conduit terminates at a gas outlet.

30. The apparatus of claim 29, further comprising a headwall unit and the gas outlet being configured to couple to the headwall unit to permit gas from the additional conduit to be supplied to the headwall unit through the gas outlet.

31. The apparatus of claim 6, further comprising a headwall unit and the additional conduit being configured to supply gas to the headwall unit.

32. The apparatus of claim 6, further comprising a pressure regulator and the additional conduit being configured to supply gas to the pressure regulator.

33. The apparatus of claim 1, wherein the plurality of water conduits are each associated with the same wall panel.

34. The apparatus of claim 1, further comprising at least one additional conduit that is configured to supply vacuum.

35. The apparatus of claim 34, further comprising a headwall unit and the additional conduit being configured to couple to the headwall unit to supply vacuum to the headwall unit.

36. The apparatus of claim 1, further comprising a shower head coupled to the first end of one of the water conduits.

37. The apparatus of claim 1, further comprising a toilet coupled to the first end of one of the water conduits.

38. The apparatus of claim 1, further comprising a sink coupled to the first end of one of the water conduits.

39. The apparatus of claim 1, further comprising a faucet coupled to the first end of one of the water conduits.

40. The apparatus of claim 1, further comprising a drain coupled to the first end of one of the water conduits.

41. The system of claim 9, wherein the water-using device includes a sink coupled to the water conduit.

42. The system of claim 9, further comprising a waste water conduit pre-plumbed in the plumbing unit and a drain coupled to the waste water conduit.

43. The system of claim 42, wherein the water-using device comprises a toilet and the drain is included in the toilet.

44. The system of claim 42, wherein the water-using device comprises a shower having a shower basin and the drain is included in the shower basin.

45. The system of claim 42, wherein the water-using device comprises a sink having a sink basin and the drain is included in the sink basin.

46. The system of claim 9, wherein the headwall unit comprises a mobile headwall unit.

47. The system of claim 9, wherein the headwall unit comprises a hi-acute headwall unit.

48. The system of claim 9, wherein the headwall unit comprises a lo-acute headwall unit.

49. The system of claim 9, wherein at least one of the plurality of wall panels comprises electrical wiring therein and an electrical connector coupled to the electrical wiring.

50. The system of claim 9, wherein at least one of the plurality of wall panels includes a door frame.

51. The system of claim 9, wherein at least one of the plurality of wall panels includes a window.

52. The system of claim 9, wherein at least one of the plurality of wall panels is formed to include a computer station.

53. The system of claim 9, wherein at least one of the plurality of wall panels is pre-plumbed with an additional conduit for the supply of vacuum.

54. The system of claim 9, wherein at least one of the plurality of wall panels includes a lighting unit.

* * * * *

UNITED STATES PATENT AND TRADEMARK OFFICE

CERTIFICATE OF CORRECTION

PATENT NO. : 6,405,491 B1
APPLICATION NO. : 09/298257
DATED : June 18, 2002
INVENTOR(S) : Dennis J. Gallant and Dennis M. Lanci It is certified that error appears in the above-identified patent and that said Letters Patent is hereby corrected as shown below:

ON THE TITLE PAGE:
Item (75), Inventors: "Dennis J. Gallant, Harrison, OH (US)" should read
--Dennis J. Gallant, Harrison, OH (US); Dennis M. Lanci, Batesville, IN (US)--

Signed and Sealed this
Fifth Day of February, 2013

Teresa Stanek Rea
*Acting Director of the United States Patent and Trademark Office*